US005956008A

United States Patent [19]

Kawasaki et al.

[11] Patent Number: 5,956,008

[45] **Date of Patent: *Sep. 21, 1999**

[54] DRIVER CIRCUIT FOR ACTIVE MATRIX DISPLAY AND METHOD OF OPERATING SAME

[75] Inventors: Yuji Kawasaki; Futoshi Ishii, both of Kanagawa, Japan

[73] Assignee: Semiconductor Energy Laboratory Co.,, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/523,380

[22] Filed: Sep. 5, 1995

Related U.S. Application Data

[63] Continuation of application No. 08/523,380, Sep. 5, 1995, abandoned.

[30] Foreign Application Priority Data

Sep. 6, 1994 [JP] Japan ..... 6-238506

[51] Int. Cl.[6] ..... G09G 3/36

[52] U.S. Cl. ..... 345/93; 345/100

[58] Field of Search ..... 345/98, 99, 100, 345/93

[56] References Cited

U.S. PATENT DOCUMENTS 4,851,827 7/1989 Nicholas ..... 340/811
5,038,368 8/1991 Lee ..... 377/28
5,063,378 11/1991 Roach ..... 345/90
5,111,060 5/1992 Asada ..... 307/219
5,173,792 12/1992 Matsueda ..... 359/59
5,465,053 11/1995 Edwards ..... 345/93

*Primary Examiner*—Amare Mengistu
*Assistant Examiner*—Ricardo Osorio
*Attorney, Agent, or Firm*—Edward D. Manzo; Mark J. Murphy

[57] ABSTRACT

A driver circuit for use with an active matrix display. The driver circuit has a shift register circuit of a redundant configuration and consists of a main circuit and a preliminary circuit. When the main circuit becomes defective, the operating circuit is automatically switched from the main circuit to the preliminary circuit without physically cutting the circuitry by a laser beam or the like. The driver circuit is composed of a main shift register circuit and a preliminary shift register circuit connected in parallel with the main shift register circuit. The output from the final stage of flip-flop circuit of the flip-flop circuits forming the main shift register circuit is compared with the output from a monitoring flip-flop circuit connected with the output of the final stage of flip-flop circuit. Thus, the output signals from the flip-flop circuits of the main shift register circuit are switched respectively to the output signals from the flip-flop circuits of the preliminary shift register circuit.

8 Claims, 10 Drawing Sheets

F/F: FLIP-FLOP CIRCUIT

MUX: MULTIPLEXER CIRCUIT

F/F: FLIP-FLOP CIRCUIT

MUX: MULTIPLEXER CIRCUIT

F/F: FLIP-FLOP CIRCUIT

MUX: MULTIPLEXER CIRCUIT

S: TIMING SIGNAL

C: CONTROL SIGNAL

F/F: FLIP-FLOP CIRCUIT

MUX: MULTIPLEXER CIRCUIT $Q_n$ : OUTPUT FROM n-th FLIP-FLOP CIRCUIT $Q_{n+1}$ : OUTPUT FROM n+1 th FLIP-FLOP CIRCUIT

−CLK : INVERTED CLOCK PULSES FOR SHIFT REGISTER CIRCUIT

DRIVER CIRCUIT FOR ACTIVE MATRIX DISPLAY AND METHOD OF OPERATING SAME

This is a continuation of application Ser. No. 08/523,380 filed on Sep. 5, 1995 now abandoned.

BACKGROUND OF THE INVENTION

1. Field of the Invention

The present invention relates to a driver circuit for use with an active matrix display and, more particularly, to a redundant shift register circuit configuration and also to a switching method.

2. Description of the Related Art

Shift register circuits using thin-film transistors (TFTs) are employed in image-sensor driver circuits and in liquid crystal display driver circuits. In recent years, such shift register circuits are often used in driver circuits for active matrix displays.

An active matrix display has pixels arranged at intersections in a matrix construction. Every pixel is equipped with a switching device. Image information is controlled by switching on and off each switching device. In the present invention, three-terminal devices, especially thin-film transistors each having a gate electrode, a source electrode, and a drain electrode, are used as switching devices. The display medium in such a display device can be liquid crystal materials, plasma, and other substances whose optical characteristics such as reflectivity, index of refraction, transmittivity, and intensity of emitted light can be varied.

In the present specification, the rows of a matrix construction are signal lines (gate lines) which extend parallel to each other and are connected to the gate electrodes of the transistors of their respective rows. The columns of the matrix construction are signal lines (source lines) which extend parallel to each other and are connected with the source (drain) electrodes of the transistors of their respective columns. A circuit for driving the gate lines is referred to herein as a gate driver circuit. A circuit for driving the source lines is referred to herein as a source driver circuit. Thin-film transistors are referred to herein as TFTs.

In a gate driver circuit, shift registers are arranged in a line and connected in series to generate a vertical scanning timing signal for an active matrix display. The number of the shift registers is equal to the number of the vertically extending gate lines. In this gate driver circuit, the TFTs in the active matrix display are switched on and off.

In a source driver circuit, shift registers are arranged in a line and connected in series to provide a display of the horizontal image data component of image data to be displayed on an active matrix display. The number of the shift registers is equal to the number of the horizontally extending source lines. The analog switches are turned on and off by pulse pulses synchronized with a horizontal scanning signal.

The TFTs are electrically activated inside the active matrix display by the source driver circuit in this way. Thus, the state of each pixel cell (i.e., whether the cell is activated or not) is controlled.

An ordinary active matrix display is now described by referring to FIG. 6. A shift register circuit X generates a timing signal in the vertical direction of the active matrix display so that a video signal is retained in an analog memory. The video signal held in the analog memory is applied to an analog buffer at the timing determined by a latch pulse. The analog buffer supplies a video signal to the source lines for the TFTs inside the active matrix display at the timing determined by the latch pulse.

On the other hand, a shift register circuit Y generates a timing signal in the horizontal direction of the active matrix display. An ON signal is applied to the gate lines for the TFTs on the same scanning line. A video signal supplied to the source lines for the TFTs determines the orientation of the pixel cells connected with the drain electrodes of the TFTs.

Generally, shift register circuits are available in forms as shown in FIGS. 7 and 8. Shift register circuits frequently use D flip-flop circuits. The shift register circuit shown in FIG. 7 utilizes analog switches. The shift register circuit shown in FIG. 8 employs clocked inverters.

In FIG. 7, if the level of the clock pulse CK is high (H), and if the level of an input signal DATA is high (H), a p-type TFT of a complementary transfer gate 701 is biased into conduction. At this time, the input signal DATA is passed through complementary inverter circuits 702 and 703. Under this condition, none of complementary transfer gates 704 and 705 are conducting.

If the level of the clock pulse CK is low (L), and if the level of the input signal DATA is high (H), then the complementary transfer gate 701 does not conduct. The previous output level H is retained. The p-type TFT of the complementary transfer gate 704 conducts. This causes the complementary inverter circuit 702 to bring the level of the input signal DATA to a low level (L).

With respect to the complementary transfer gate 705, if the level at the output terminal of the complementary transfer gate 705 is low (L), then this is same level as the level at the input terminal. In this state, no current flows.

However, output signal Q is made to go high (H) via a complementary inverter circuit 706. If the level at the output terminal of the complementary transfer gate 705 is high (H), then the n-type TFT is driven into conduction. The complementary inverter circuit 702 recovers electric charge, thus inverting the level to a low level (L).

Also at this time, the output signal Q is made to go high (H) via the complementary inverter circuit 706. In either case, the output signal Q is at a high level (H). At this time, the complementary transfer gate 708 does not conduct.

If the level of the clock pulse CK is high (H), and if the level of the input signal DATA is low (L), the n-type TFT of the complementary transfer gate 701 conducts. The input signal DATA is made to go low (L) via the complementary inverter circuits 702 and 703.

At this time, none of the complementary transfer gates 704 and 705 conduct but the previous output level L is retained. The n-type TFT of the complementary transfer gate 708 conducts. A signal of a low level (L) is applied to the complementary inverter circuit 706. The output signal Q is maintained at a high level (H).

If the level of the clock pulse CK is low (L), and if the level of the input signal DATA is low (L), the n-type TFT of the complementary transfer gate 704 conducts as mentioned previously. This causes the complementary inverter circuit 702 to bring the input signal DATA to a high level (H).

At the same time, the p-type TFT of the complementary transfer gate 705 conducts. The output signal Q is made to go low (L) via the complementary inverter circuit 706. At this time, the complementary transfer gate 708 is not conducting. In this way, a D flip-flop circuit is formed by the analog switches.

In FIG. 8, if the level of the clock pulse CK is high (H), and if the level of the input signal DATA is high (H), the level of the output from a complementary clocked inverter circuit 801 is low (L). This level is inverted to a high level (H) via a complementary inverter circuit 802. At this time, none of complementary clocked inverter circuits 803 and 804 are conducting.

If the level of the clock pulse CK is low (L), and if the level of the input data DATA is high (H), the complementary clocked inverter circuit 803 are biased into conduction. The output level is made to go low (L). A signal of a high level (H) is applied to the complementary clocked inverter circuit 804 again via the complementary inverter circuit 802.

The complementary clocked inverter circuit 804 conducts, inverting the output level to a low level (L). This is applied to the complementary inverter circuit 805, which in turn produces a signal of a high level (H). The level of the output signal Q is high (H). At this time, the complementary clocked inverter circuit 806 is not conducting.

If the level of the clock pulse CK is high (H), and if the level of the input signal DATA is low (L), the complementary clocked inverter circuit 801 conducts. The output level is made to go high (H). This level is inverted to a low level (L) via the complementary inverter circuit 802.

At this time, none of the complementary clocked inverter circuits 803 and 804 are conducting. However, the high-level output (H) held by the complementary inverter circuit 805 is applied to the conducting complementary clocked inverter circuit 806. As a result, the output level is made to go low (L). Accordingly, the level of the output signal Q is maintained high (H) via the complementary inverter circuit 805.

If the level of the clock pulse CK is low (L), and if the level of the input signal DATA is low (L), the complementary clocked inverter circuit 803 conducts, causing the output level to go high (H). A signal of a low level (L) is applied to the complementary clocked inverter circuit 804 again via the complementary inverter circuit 802.

The complementary inverter circuit 804 is biased into conduction. The output level is made to go high (H). This is applied to the complementary inverter circuit 805, which in turn produces a low-level signal (L). The output signal Q is made to go low (L). In this state, the complementary clocked inverter circuit 806 is cut off. In this manner, a D flip-flop circuit is built from the clocked inverters.

In the prior art shift register circuits forming the gate and source driver circuits, respectively, of an active matrix display, shift register circuits which are equal in number with the gate lines and source lines of the display device are connected in series as shown in FIGS. 4 and 5, respectively.

In the case of the gate driver circuit, the outputs of the shift register circuits are connected with the gate lines via an inverter type buffer circuit, as shown in FIG. 4.

In the case of the source driver circuit, the outputs of the shift register circuits are connected with the control terminal of a sampling transmission gate via an inverter type buffer circuit, as shown in FIG. 5.

For this reason, if the shift register circuits connected in series contain at least one defective or faulty flip-flop circuit, then image data and the scanning time for the display device which are delivered from the flip-flop circuits connected after the defective flip-flop circuit are not normal. Hence, a precise image cannot be obtained.

It is known that a redundant circuit having a plurality of shift register circuits can be provided to prevent the above-described undesirable situation. Where this configuration is adopted, during fabrication, a waveform showing the pattern obtained from one shift register circuit is observed. If a defect is found, the pattern of the shift register circuit is cut by a laser beam or the like. The operating shift register circuit is switched to the preliminary shift register circuit. Therefore, dedicated tools and installation are necessary. In this construction, if any one shift register circuit becomes defective after the apparatus has been assembled, then the apparatus must be disassembled, and the substrate holding the shift register circuit must be replaced with a new one.

SUMMARY OF THE INVENTION

It is an object of the present invention to provide a driver circuit which is for use with an active matrix display, is equipped with a redundant shift register circuit, and in which if a trouble occurs with the main circuit, then the operating circuit is automatically switched from the main circuit to the preliminary circuit within the circuitry without the need to cut the circuitry by a laser beam.

The above-described object is achieved in accordance with the teachings of the present invention by a method of operating a driver circuit for use with an active matrix display, said driver circuit having a plurality of shift register circuits connected in parallel, said shift register circuits consisting of a main shift register circuit and a preliminary shift register circuit, respectively, said method comprising the step of: automatically switching said main shift register circuit to said preliminary shift register circuit if said main shift register circuit is at fault.

Another embodiment of the present invention is a method of operating a driver circuit for use with an active matrix display, said driver circuit having a plurality of shift register circuits connected in parallel, said shift register circuits consisting of a main shift register circuit and a preliminary shift register circuit, respectively, said main shift register circuit consisting of flip-flop circuits including a final stage of flip-flop circuit, said method comprising the steps of: connecting a monitoring flip-flop circuit with output of said final stage of flip-flop circuit of said main shift register circuit; and comparing an output signal from said final stage of flip-flop circuit with an output signal from said monitoring flip-flop circuit to detect abnormal operation of said main shift register circuit if such abnormal operation takes place.

A further embodiment of the present invention is a method of operating a driver circuit for use with an active matrix display, said driver circuit having a plurality of shift register circuits connected in parallel, said shift register circuits consisting of a main shift register circuit and a preliminary shift register circuit, respectively, said main shift register circuit consisting of flip-flop circuits including a final stage of flip-flop circuit, said method comprising the steps of: connecting a monitoring flip-flop circuit with output of said final stage of flip-flop circuit of said main shift register circuit; comparing an output signal from said final stage of flip-flop circuit with an output signal from said monitoring flip-flop circuit to detect abnormal operation of said main shift register circuit if such abnormal operation takes place; and then using an output signal from said preliminary shift register circuit.

An additional embodiment of the present invention is a driver circuit for use with an active matrix display, said driver circuit comprising: a main shift register circuit consisting of flip-flop circuits including a final stage of flip-flop circuit;

a preliminary shift register circuit connected in parallel with said main shift register circuit; a monitoring flip-flop circuit connected with output of said final stage of flip-flop circuit of said main shift register circuit; an output comparison circuit for comparing an output signal from said final stage of flip-flop circuit with an output signal from said monitoring flip-flop circuit; and multiplexer circuits connected into their respective stages of flip-flop circuits of said main and preliminary shift register circuits to switch output signals from the flip-flop circuits of said main shift register circuit to output signals from the flip-flop circuits of said preliminary shift register circuit in response to an output signal from said output comparison circuit.

A still further embodiment of the present invention is a driver circuit for use with an active matrix display, said driver circuit comprising: a main shift register circuit made up of a plurality of blocks each consisting of a plurality of flip-flop circuits, each block including a final stage of flip-flop circuit; a preliminary shift register circuit connected in parallel with said main shift register circuit, said preliminary shift register circuit being made up of a plurality of blocks each consisting of a plurality of flip-flop circuits; monitoring flip-flop circuits connected with their respective outputs of said final stages of flip-flop circuits of said blocks of said main shift register circuit; output comparison circuits for comparing output signals from said final stages of flip-flop circuits of the blocks of said main shift register circuit with output signals from their corresponding ones of said monitoring flip-flop circuits; first multiplexer circuits for switching an output signal from a given block of said main shift register circuit to an output signal from a corresponding block of said preliminary shift register circuit in response to output signals from said output comparison circuit; and second multiplexer circuits for switching an output signal from said flip-flop circuit in said selected given block of said main shift register circuit to an output signal from the flip-flop circuit in a corresponding block of said preliminary shift register circuit.

Yet another embodiment of the present invention is a driver circuit for use with an active matrix display, said driver circuit comprising: a main flip-flop circuit system consisting of a plurality of stages of flip-flop circuits; a preliminary flip-flop circuit system connected in parallel with said main flip-flop circuit system, said preliminary flip-flop circuit system consisting of a plurality of stages of flip-flop circuits; output comparison circuits each connected between input and output of each stage of the flip-flop circuit of said main flip-flop circuit system, for comparing signals applied to the stages of flip-flop circuits of said main flip-flop circuit system with output signals from these stages of flip-flop circuits; and multiplexer circuits for switching an output signal from any one stage of said main flip-flop circuit system to an output signal from an output signal from a corresponding stage of said preliminary flip-flop circuit system in response to output signals from said output comparison circuits.

The main circuit referred to herein is included in a circuit which has a redundant configuration and preferably operates normally when manufacture of the driver circuit is started. The preliminary circuit referred to herein is a redundant circuit to which the operating circuit is switched from the main circuit if the main circuit fails to operate normally.

Specifically, the present invention has the following configurations:

(1) The output signal from the final stage of flip-flop circuit of the main shift register circuit is compared with the output signal from the monitoring flip-flop circuit located after the final stage of flip-flop circuit, to judge whether the operation is abnormal. If the operation is abnormal, the output signal from the preliminary shift register circuit is used.

(2) A plurality of flip-flop circuits forming a main shift register circuit are divided into plural blocks. A monitoring flip-flop circuit is located after the final stage of each block. The output signal from the final stage of each block is compared with the output signal from the monitoring flip-flop circuit. In this way, a decision is made as to whether the operation is normal or not. If the operation is abnormal, the output from that block of the preliminary shift register circuit which corresponds to the defective block of the main shift register circuit is used.

(3) Each shift register circuit comprises a plurality of stages. Each stage consists of a main flip-flop circuit and a preliminary flip-flop circuit which are connected in parallel with each other. In each stage, the input signal to the main flip-flop circuit is compared with the output signal from this main flip-flop circuit to judge whether the operation is abnormal or not. If the operation is abnormal, the output signal from the preliminary flip-flop circuit, connected in parallel with the main flip-flop circuit, is used.

In this way, the operating circuit is electrically switched from the main circuit to the preliminary circuit. As a result, the production yield of the driver circuit for the active matrix display is improved.

Other objects and features of the invention will appear in the course of the description thereof, which follows.

BRIEF DESCRIPTION OF THE DRAWINGS

FIG. 2(*b*) is a block diagram of a shift register circuit of Example 2;

FIG. 9(*b*) is a circuit diagram of the exclusive-OR gate made up of transistors;

FIG. 10(*b*) is a circuit diagram of the multiplexer circuit made up of transistors;

DETAILED DESCRIPTION OF THE PREFERRED EMBODIMENTS

EXAMPLE 1

The present example is composed of two circuits, i.e., a main shift register circuit and a preliminary shift register circuit. These two shift register circuits receive common clock pulses and common input signals and operate in the same way.

Figure 1:
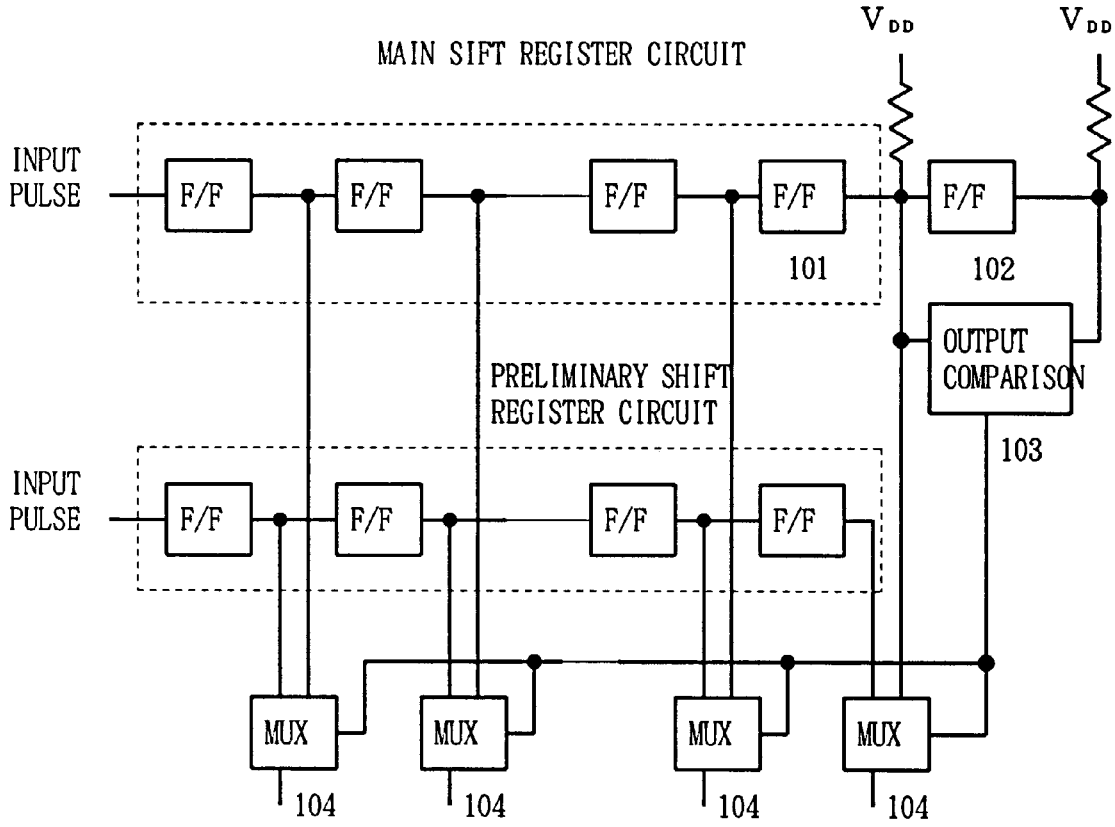
FIG. 1 is a block diagram of a driver circuit of Example 1 of the present invention, the driver circuit including a redundant shift register circuit.

FIG. 1 is a block diagram of a driver circuit of the present example, the driver circuit including a redundant shift register circuit. This driver circuit has an output comparison circuit 103 which makes a decision as to whether the main shift register circuit is operating normally. A monitoring flip-flop circuit 102 is connected to the output of the final stage of flip-flop circuit 101 which is included in the flip-flop circuits forming the main shift register circuit. The output signal from the final stage of flip-flop circuit 101 and the output signal from the monitoring flip-flop circuit 102 are EXCLUSIVE ORed by the output comparison circuit 103 to judge whether this main shift register circuit is operating normally.

If the shift register circuit contains line breakage or other trouble, there is the possibility that the output signals from the flip-flop circuits cannot be judged. To prevent this, a pull-up or pull-down resistor is connected to the output terminal of the final stage of flip-flop circuit 101. Also, a pull-up or pull-down resistor is connected to the output terminal of the monitoring flip-flop circuit 102 located after the flip-flop circuit 101. In this way, logical states are established.

If the main shift register circuit is operating normally, the output comparison circuit 103 produces an output signal to multiplexer circuits 104 to select only the output signal from the main shift register circuit. These multiplexer circuits 104 are connected to their respective output signal lines extending from the flip-flop circuits of the main and preliminary shift register circuits.

If the main shift register circuit is not operating normally, the output comparison circuit 103 produces an output signal to the multiplexer circuits 104 to select the output signal from the preliminary shift register circuit.

Figure 11:
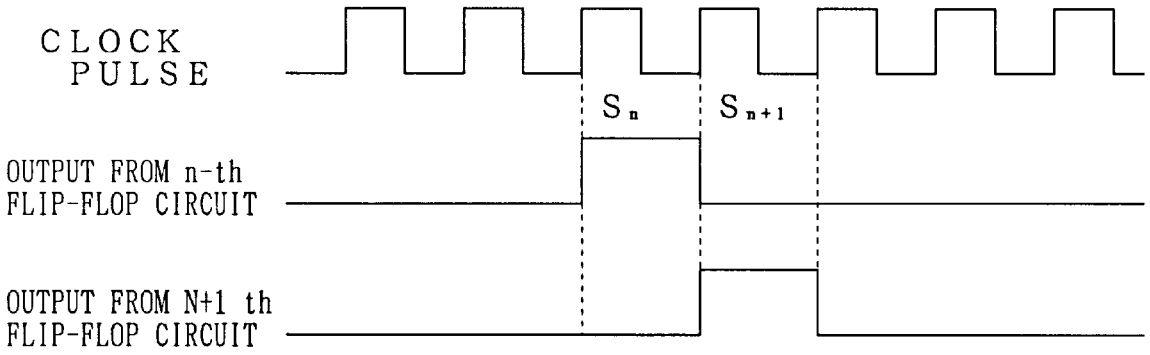
FIG. 11 is a timing chart illustrating operation of each shift register circuit used in the present invention.

The operation of the present example will now be described in further detail. FIG. 11 is a timing chart illustrating the operation of a shift register circuit. When an input signal and clock pulses are applied to the shift register circuit, each flip-flop circuit produces a pulse having a length equal to one period of the clock pulses. Because of the configuration of the shift register circuit, if it contains a defect, the final output from the circuit is not produced at the intended timing. Therefore, it is possible to know whether a defect is present, by comparing the output signal from the final stage of the shift register circuit (n-th flip-flop circuit) with the output signal from the monitoring flip-flop circuit ((n+1)th flip-flop circuit) connected after the final stage.

Figure 12:
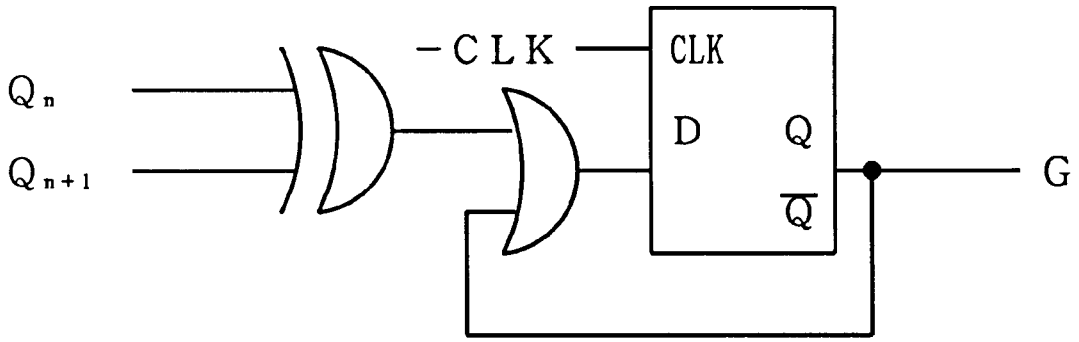
FIG. 12 is an equivalent circuit diagram of an output comparison circuit used in the present invention.

FIG. 12 is an equivalent circuit diagram of an output comparison circuit used in the present invention. In the present example, the first through n–th stages of flip-flop circuits are used to form a shift register circuit. The (n+1)th flip-flop circuit is used to check the operation of the shift register circuit and referred to herein as the monitoring flip-flop circuit.

Referring to FIG. 11, if the output signal from the n-th flip-flop circuit and the output signal from the (n+1)th flip-flop circuit (monitoring flip-flop circuit) assume normal values, the output comparison circuit maintains a high level (H) during a period of $S_{n+1}$ to select the main shift register circuit. If the output signals from the flip-flop circuits do not assume normal values, the output comparison circuit maintains a low level (L) even after a lapse of the period of $S_{n+1}$ to select the preliminary shift register circuit.

Figure 9:
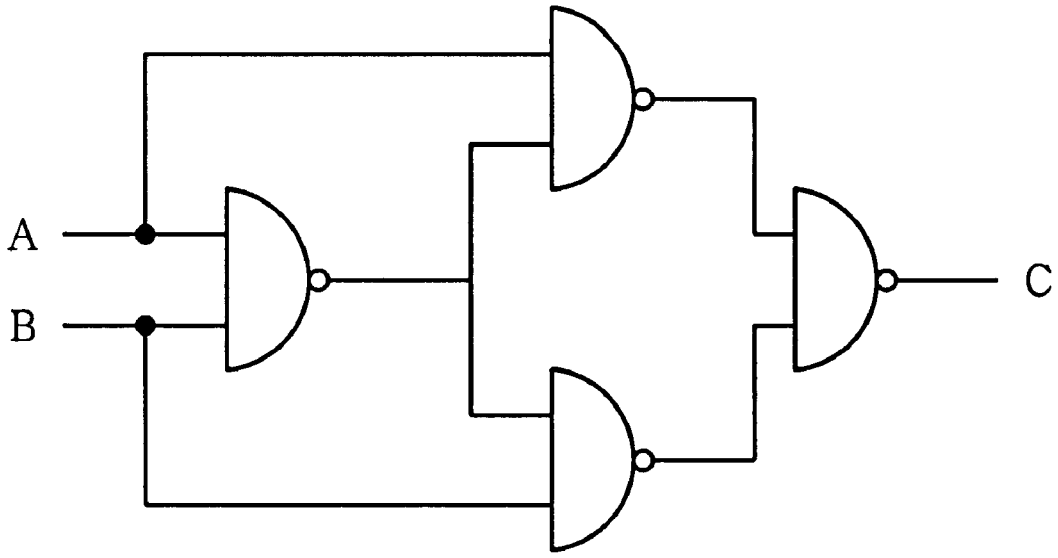
FIG. 9(*a*) is a logic circuit of an exclusive-OR gate forming an output comparison circuit used in the present invention.
Figure 9:
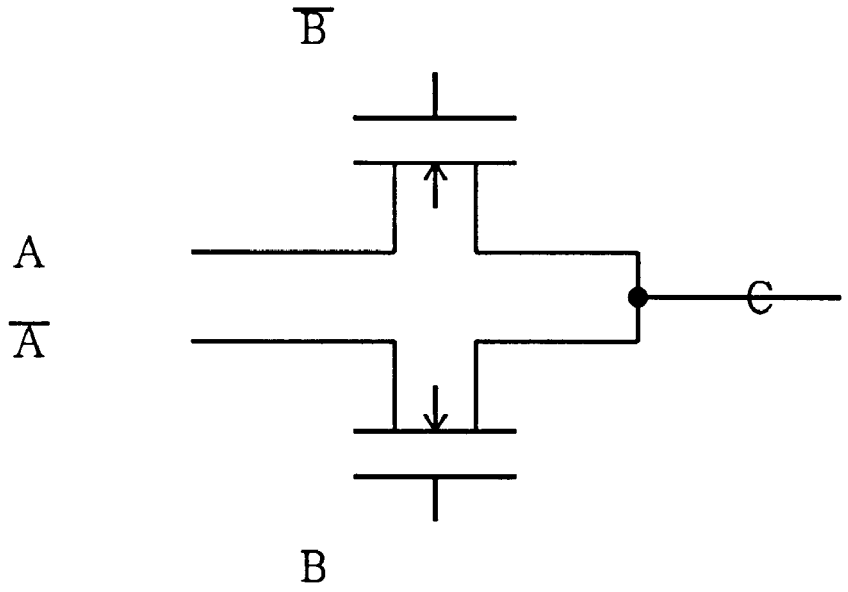

FIGS. 9(*a*) and 9(*b*) are equivalent circuit diagrams of an EXOR gate forming the output comparison circuit described above. FIG. 9(*a*) shows an example of a logic circuit. FIG. 9(*b*) shows an example of the circuit formed by transistors.

Figure 10:
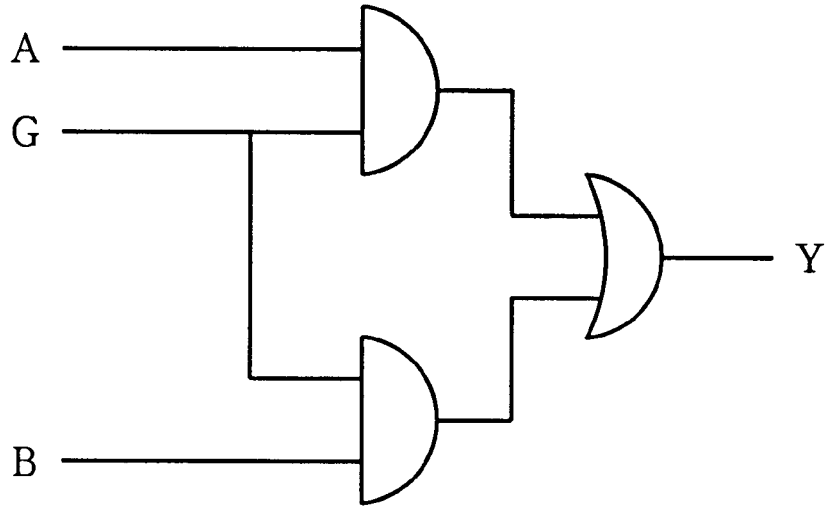
FIG. 10(*a*) is a logic circuit of a multiplexer circuit used in the present invention.
Figure 10:
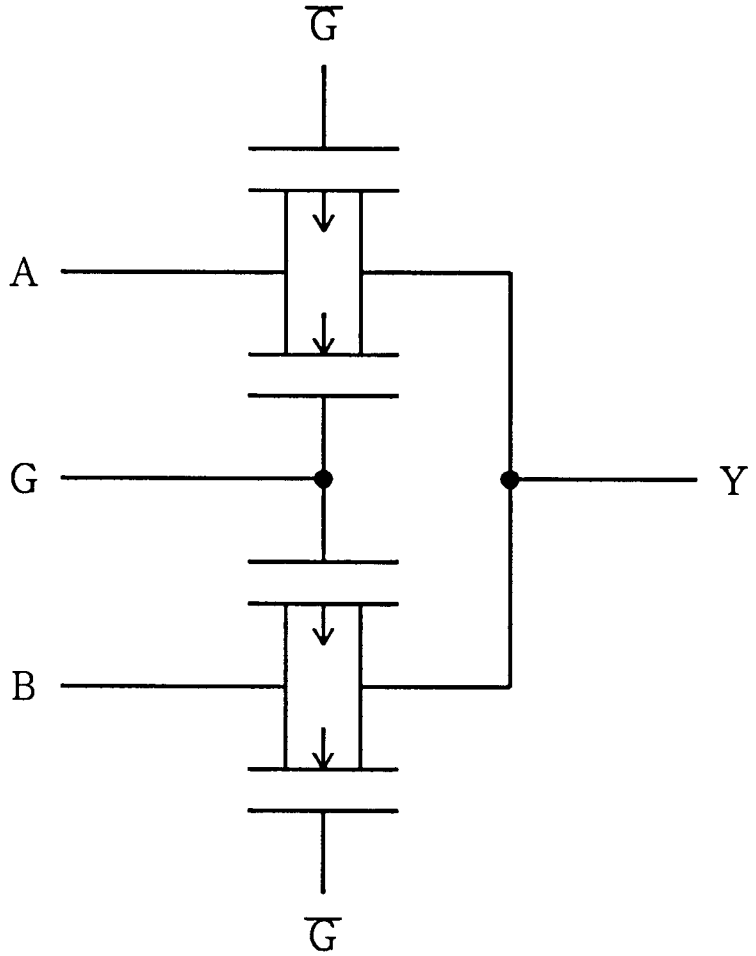

FIGS. 10(*a*) and 10(*b*) are equivalent circuit diagrams of a multiplexer circuit used in the present invention. The multiplexer circuit acts to switch the flip-flop circuit producing a used output signal between the main register circuit and the preliminary register circuit in response to the held output signal from the output comparison circuit. In this way, a defective shift register circuit in the circuitry can be automatically switched to the normal shift register circuit without-cutting the circuitry by a laser beam or the like.

EXAMPLE 2

Figure 2:
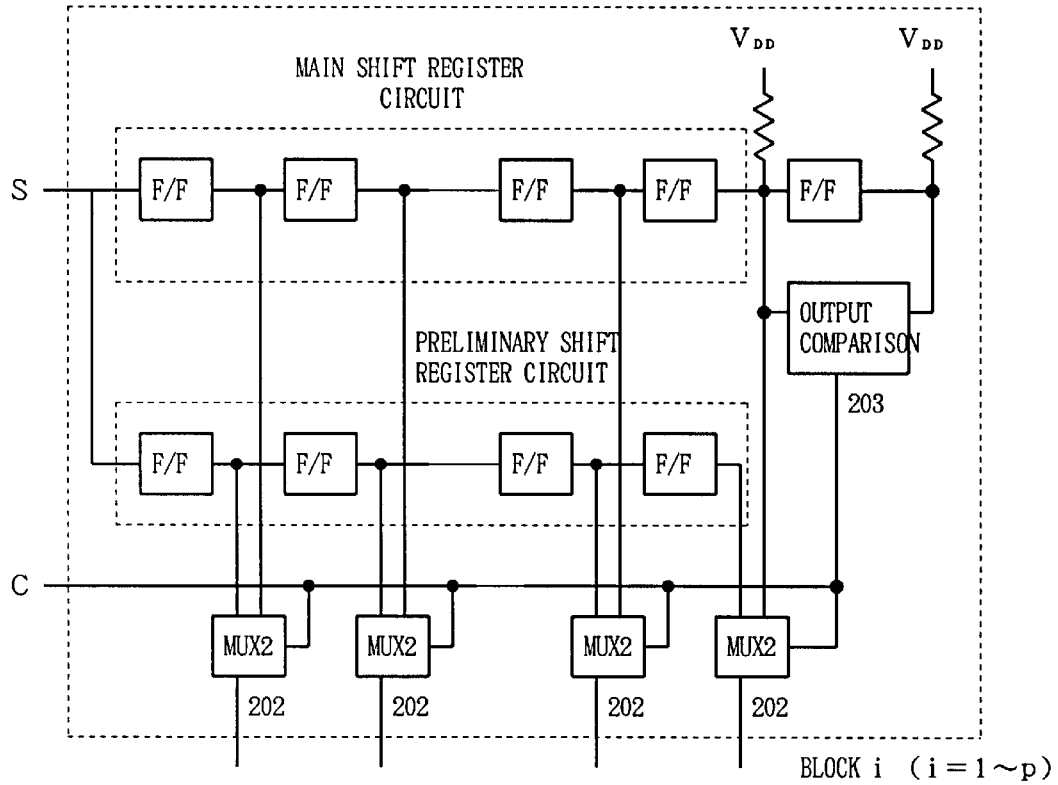
FIG. 2(*a*) is a block diagram of one block of a driver circuit of Example 2, the block including a redundant configuration.
Figure 2:
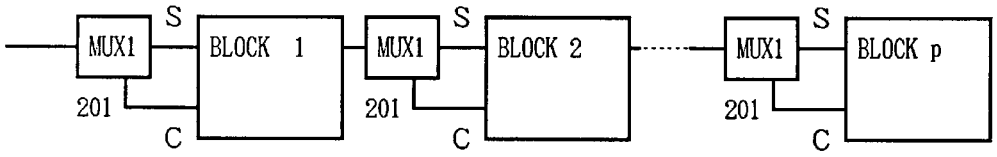

In this example, each shift register circuit is divided into plural blocks. Each block is designed to have redundancy. FIGS. 2(*a*) and 2(*b*) are block diagrams of a shift register circuit which is made redundant according to the present example. FIG. 2(*a*) shows the structure inside each block. FIG. 2(*b*) shows the structure of the whole shift register.

In the present example, each of the main and preliminary shift register circuits is divided into p blocks ($0<p<n$). Each block is equipped with an output comparison circuit. Each shift register circuit operates in the same way as in Example 1.

The output of each output comparison circuit is connected to a multiplexer circuit 1 (201) and to a multiplexer circuit 2 (202). Each one block includes (q+1) flip-flop circuits ($0<q\leqq(n/p)$). The output comparison circuits are the same as the output comparison circuit used in Example 1. In the present example, the first through q-th flip-flop circuits inside one block are used to form a shift register circuit. The (q+1)th flip-flop circuit is used to check the operation of the shift register circuit in the block.

Each multiplexer circuit 1 (201) selects one from two output signals in response to the output signal from the corresponding output comparison circuit. One of these two output signals is the output from the corresponding shift register circuit in the corresponding block of the main shift register circuit, while the other is the output from the corresponding shift register circuit in the corresponding block of the preliminary shift register circuit. The selected signal is passed to the next block.

Each multiplexer circuit 2 (202) selects either the output from the main shift register circuit or the output from the preliminary shift register circuit inside the same block in response to the output signal from the corresponding output comparison circuit. The selected signal is supplied to the gate electrode or source electrode of a TFT. Equivalent circuits of the multiplexer circuits 1 (201) and 2 (202) and of the output comparison circuits 203 are the same as the equivalent circuits of their counterparts of Example 1. Also, the multiplexer circuits and the output comparison circuits operate in the same way as in Example 1.

EXAMPLE 3

Figure 3:
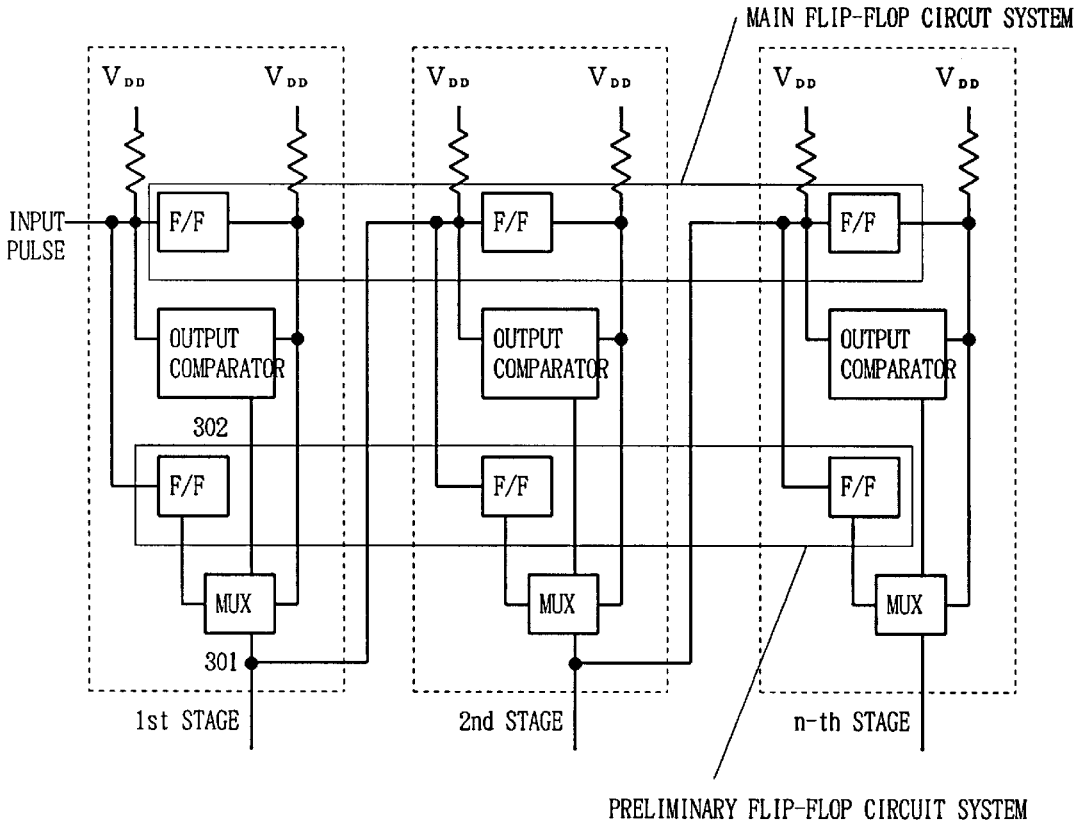
FIG. 3 is a block diagram of a driver circuit of Example 3, the driver circuit including a redundant shift register circuit.
Figure 4:
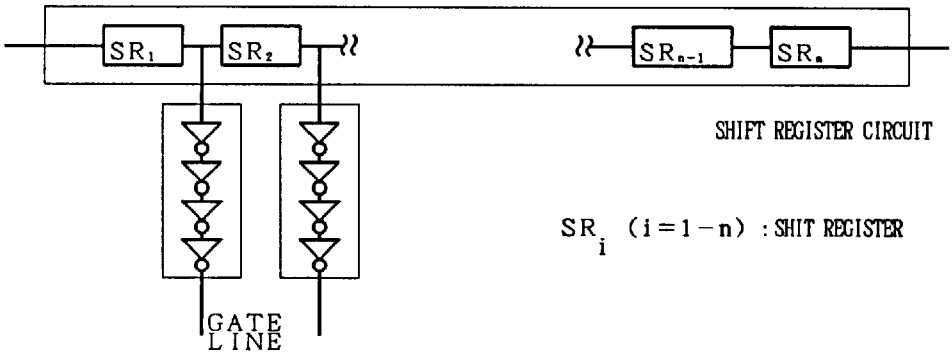
Fig 4 (prior art)
FIG. 4 is a diagram of a conventional gate driver circuit.
Figure 5:
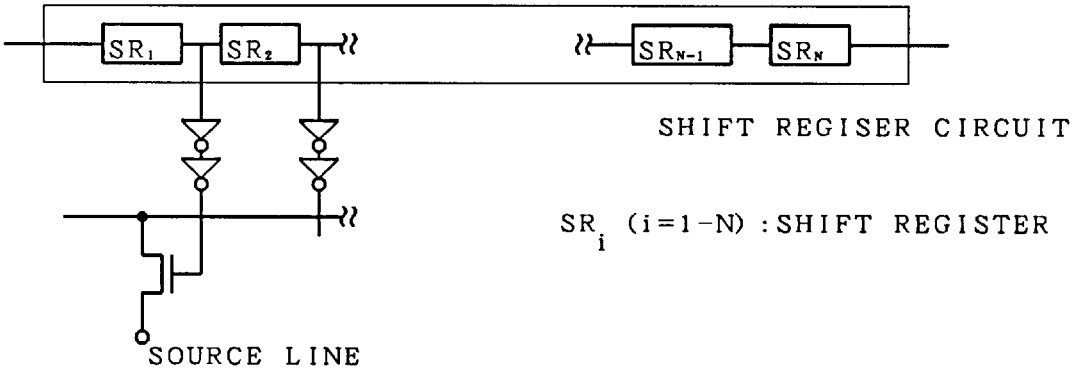
Fig 5 (prior art)
FIG. 5 is a diagram of a conventional source driver circuit.
Figure 6:
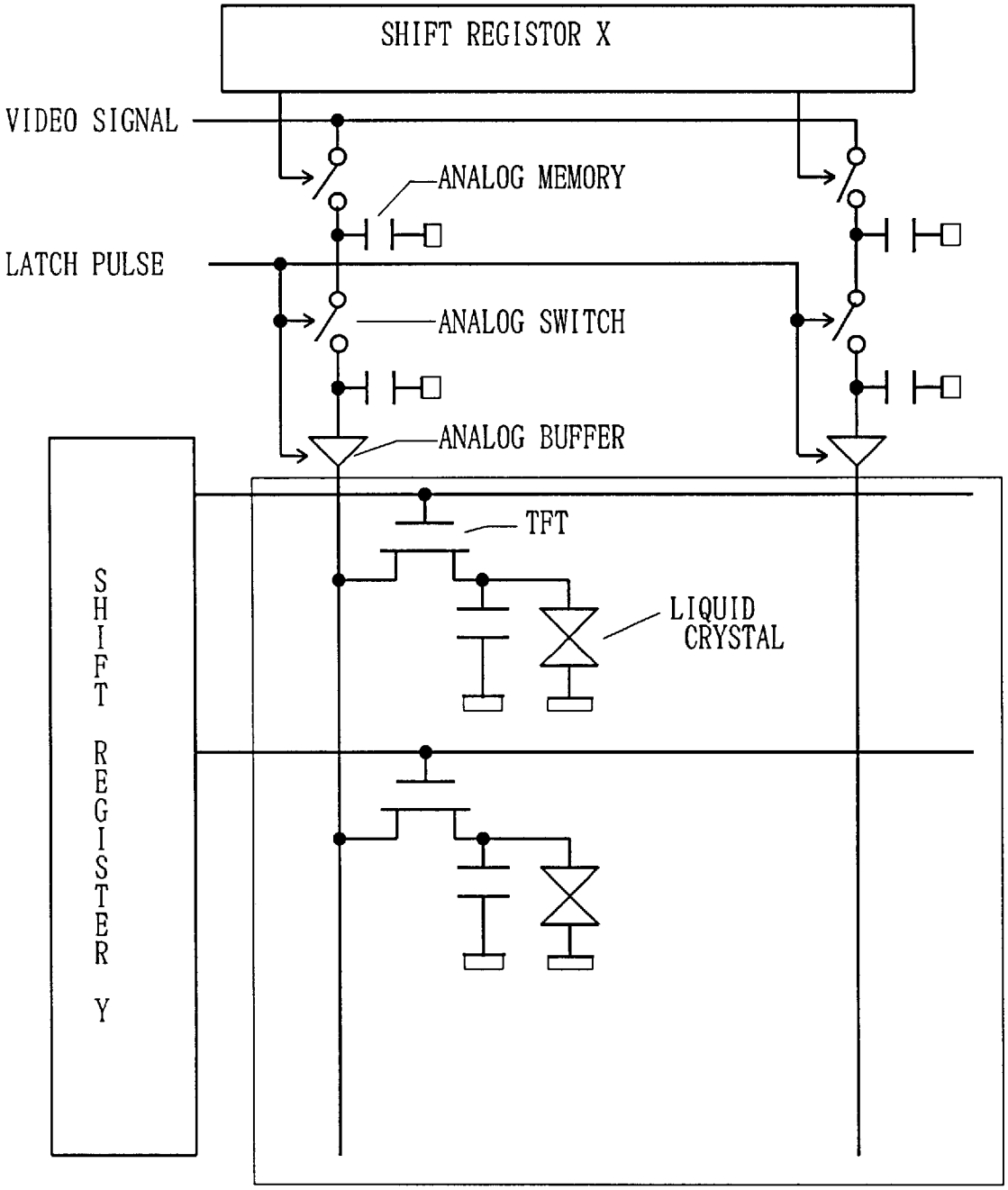
Fig. 6 (prior art)
FIG. 6 is a schematic diagram of a conventional active matrix display.
Figure 7:
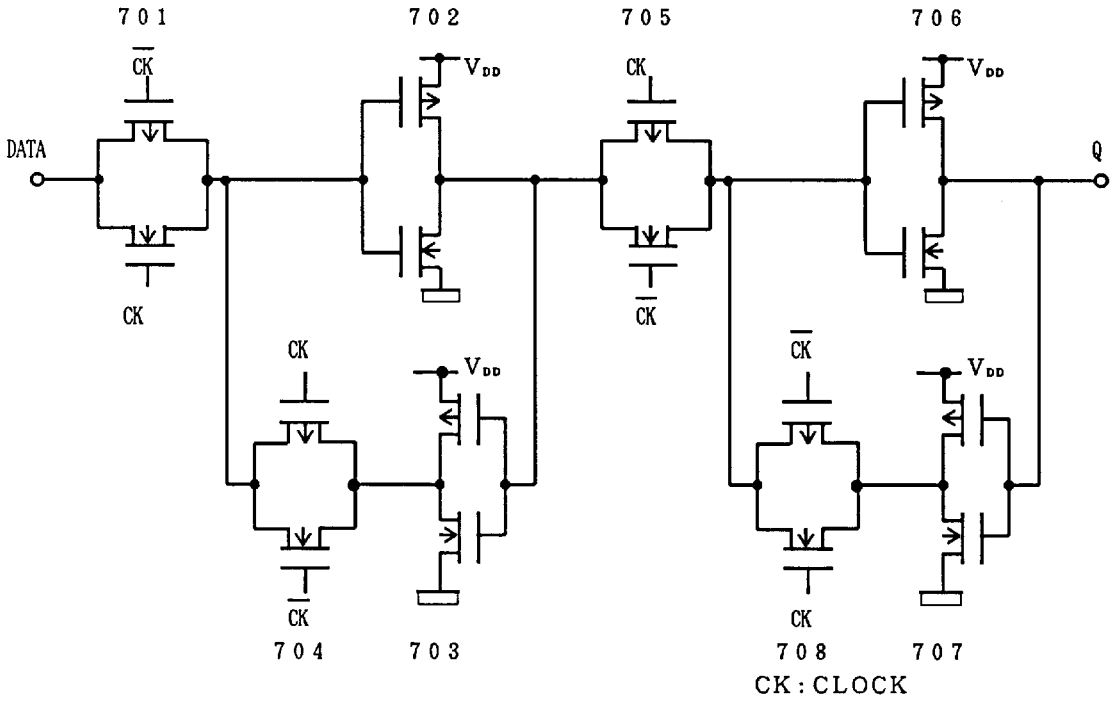
Fig. 7 (Prior Art)
FIG. 7 is a diagram of a conventional D flip-flop circuit using analog switches.
Figure 8:
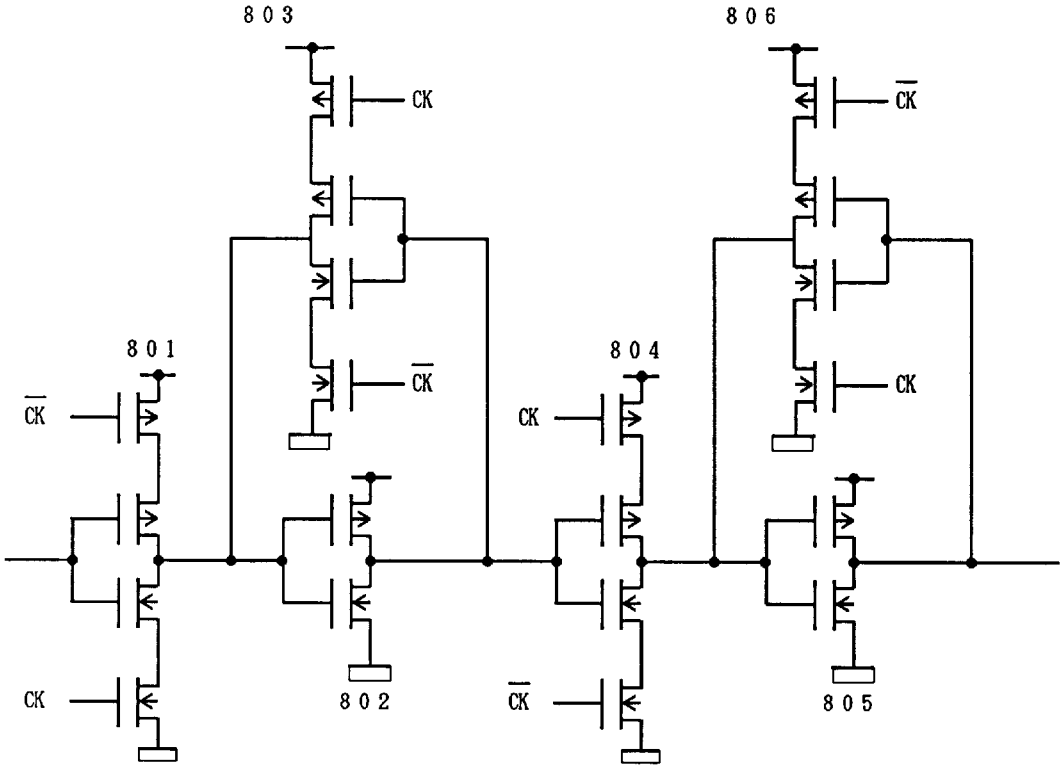
Fig. 8 (Prior Art)
FIG. 8 is a diagram of a conventional D flip-flop circuit using clocked inverters.

FIG. 3 shows a redundant circuit according to this example. In the present example, a main flip-flop circuit and a preliminary flip-flop circuit are connected in parallel to form a shift register circuit in each stage. Each stage is equipped with both an output comparison circuit and a multiplexer circuit. In this example, each output comparison circuit compares a signal applied to the corresponding flip-flop circuit of the main flip-flop circuit with the output signal from this flip-flop circuit and makes a decision.

The shift register circuits operate in the same way as in Example 1. The output signals from the output comparison circuits are supplied to their corresponding multiplexer circuits.

A multiplexer circuit 301 in one stage selects the output from the main flip-flop circuit or the output from the preliminary flip-flop circuit in response to the output signal from the output comparison circuit in the same stage. The selected output signal is passed to the next stage. The multiplexer circuit 301 couples the output from the flip-flop circuit in the same stage to the gate electrode or source electrode of a TFT. Equivalent circuits of the multiplexer circuits 301 and output comparison circuits 302 are the same as the equivalent circuits of their counterparts of Example 1. Also, the multiplexer circuits 301 and the output comparison circuits 302 operate in the same way as in Example 1.

In the present example, if the operation of the main shift register circuit is abnormal, the circuit can be automatically switched to the normally operating preliminary circuit. Therefore, when the circuit is switched to the preliminary circuit, it is not necessary to cut the circuit by a laser beam or the like. Consequently, active matrix displays having built-in driver circuits can be manufactured with improved yield. Furthermore, the production steps can be made easier.

What is claimed is:

1. A method of operating a driver circuit in an active matrix display, said driver comprising:

a main shift register circuit including a plurality flip-flop circuits with a final stage of a flip-flop circuit;

a preliminary shift register circuit including a plurality of flip-flop circuits with a final stage of a flip-flop circuit, wherein said main shift register and said preliminary shift register are connected in parallel;

a plurality of multiplexer circuits, each being connected to both a first output of each of the plurality of flip-flop circuits in the main shift register and a first output of each of the plurality of flip-flop circuits in the preliminary shift register, wherein each of the plurality of multiplexer circuits are for switching a first output signal of each of the plurality of flip-flop circuits on the main shift register to a first output signal of each of the plurality of flip-flop circuits in the preliminary shift register;

at least one monitoring flip-flop circuit being connected to said final stage of the flip-flop circuit of said main shift register while not being connected to said final stage of the flip-flop circuit of said preliminary shift register;

at least one output comparison circuit including a first input, a second input, and a first output, said first input of the output comparison circuit being connected to a second output of the final stage of the flip-flop circuit in the main shift register, said second input of the output comparison circuit being connected to a first output of the monitoring flip-flop circuit, said first output of the output comparison circuit being connected to each of the plurality of multiplexer circuits, wherein said output comparison circuit is for comparing a second output signal of the final stage of the flip-flop circuit of said main shift register with an output signal from said monitoring flip-flop circuit, wherein each of the plurality of multiplexer circuits switches the first output signal of each of the plurality of flip-flop circuits in the main shift register to the first output signal of each of the plurality of flip-flop circuits in the preliminary shift register in response to an output signal from the output comparison circuit;

said method comprising the steps of:

comparing the second output signal from said final stage of the flip-flop circuit of said main shift register with the output signal from said monitoring flip-flop circuit to detect abnormal operation of said main shift register circuit if such abnormal operation takes place, wherein each of said multiplexer circuits includes at least a CMOS transistor having at least an n-channel thin film transistor and a p-channel thin film transistor being connected complementarily.

2. A method of operating a driver circuit in an active matrix display, said driver circuit comprising:

a main shift register circuit including a plurality of flip-flop circuits with a final stage of a flip-flop circuit;

a preliminary shift register circuit including a plurality of flip-flop circuits with a final stage of a flip-flop circuit, wherein said main shift register and said preliminary shift register are connected in parallel;

a plurality of multiplexer circuits, each being connected to both a first output of each of the plurality of flip-flop circuits in the main shift register and a first output of each of the plurality of flip-flop circuits in the preliminary shift register, wherein each of the plurality of multiplexer circuits are for switching a first output signal of each of the plurality of flip-flop circuits in the main shift register to a first output signal of each of the plurality of flip-flop circuits in the preliminary shift register;

at least one monitoring flip-flop circuit being connected to said final stage of the flip flop circuit of said main shift register while not being connected to said final stage of the flip-flop circuit of said preliminary shift register;

at least one output comparison circuit including a first input, a second input, and a first output, said first input of the output comparison circuit being connected to a second output of the final stage of the flip-flop circuit in the main shift register, said second input of the output comparison circuit being connected to a first output of the monitoring flip-flop circuit, said first output of the output comparison circuit being connected to each of the plurality of multiplexer circuits, wherein said output comparison circuit is for comparing a second output signal of the final stage of the flip-flop circuit of said main shift register with an output signal from said monitoring flip-flop circuit, wherein each of the plurality of multiplexer circuits switches the first output signal of each of the plurality of flip-flop circuits in the main shift register to the first output signal of each of the plurality of flip-flop circuits in the preliminary shift register in response to an output signal from the output comparison circuit, said method comprising the steps of:

comparing the second output signal from said final stage of the flip-flop circuit of said main shift register with the output signal from said monitoring flip-flop circuit to detect abnormal operation of said main shift register circuit if such abnormal operation takes place; and then if such abnormal operation takes place, switching the first output signal from each of the plurality of flip-flop circuits in the main shift register to the first output signal from each of the plurality of flip-flop circuits in said preliminary shift register circuits, wherein each of said multiplexer circuits includes at least a CMOS transistor having at least an n-channel thin film transistor and a p-channel thin film transistor being connected complementarily.

3. A driver circuit in an active matrix display, said driver circuit comprising:

a main shift register circuit comprising a plurality of flip-flop circuits including a final stage of a flip-flop circuit;

a preliminary shift register circuit comprising a plurality of flip-flop circuits including a final stage of a flip-flop circuit, wherein said main shift register and said preliminary shift register are connected in parallel;

a plurality of multiplexer circuits, each being connected to both a first output of each of the plurality of flip-flop circuits in the main shift register and a output of each of the plurality of flip-flop circuits in the preliminary shift register, wherein each of the plurality of multiplexer circuits are for switching a first output signal of each of the plurality of flip-flop circuits in the main shift register to a first output signal of each of the plurality of flip-flop circuits in the preliminary shift register;

at least one monitoring flip-flop circuit being connected to said final stage of the flip flop circuit of said main shift register while not being connected to said final stage of the flip-flop circuit of said preliminary shift register;

at least one output comparison circuit including a first input, a second input, and a first output, said first input of the output comparison circuit being connected to a second output of the final stage of the flip-flop circuit in the main shift register, said second input of the output comparison circuit being connected to a first circuit being connected to each of the plurality of multiplexer circuits, wherein said output comparison circuits is for comparing a second output signal of the final stage of the flip-flop circuit of said main shift register with an output signal from said monitoring flip-flop circuit, wherein each of the plurality of multiplexer circuits switches the first output signal of each of the plurality of flip-flop circuits in the main shift register to the first output signal of each of the plurality of flip-flop circuits in the preliminary shift register in response to an output signal from the output comparison circuit, wherein each of the plurality of multiplexer circuits includes at least a CMOS transistor having at least an n-channel thin film transistor and a p-channel thin film transistor being connected complementarily.

4. A driver circuit in an active matrix display, said driver circuit comprising:

a plurality of blocks, wherein each of the plurality of blocks includes:

a main shift register circuit comprising a plurality of flip-flop circuits including a final stage of a flip-flop circuit;

a preliminary shift register circuit comprising a plurality of flip-flop circuits including a final stage of a flip-flop circuit, wherein said main shift register and said preliminary shift register are connected in parallel;

a first plurality of multiplexer circuits, each being connected to each of the plurality of blocks;

a second plurality of multiplexer circuits, each being connected to both a first output of each of the plurality of flip-flop circuits in the main shift register and a first output of each of the plurality of flip-flop circuits in the preliminary shift register;

wherein each of the plurality of multiplexer circuits are for switching a first output signal of each of the plurality of flip-flop circuits in the main shift register to a first output signal of each of the plurality of flip-flop circuits in the preliminary shift register;

a monitoring flip-flop circuit being connected to said final stage of the flip-flop circuit of said main shift register while not being connected to said final stage of the flip-flop circuit of said preliminary shift register;

an output comparison circuit including a first input, a second input, and a first output;

said first input of the output comparison circuit being connected to a second output of the final stage of the flip-flop circuit in the main shift register, said second input of the output comparison circuit being connected to a first output of the monitoring flip-flop circuit, said first output of the output comparison circuit being connected to each of the plurality of multiplexer circuits, wherein said output comparison circuit is for a second output signal of the final stage of the flip-flop circuit of said main shift register with an output signal from said monitoring flip-flop circuit, wherein each of the second plurality of multiplexer circuits switches the first output signal of each of the plurality of flip-flop circuits in the main shift register to the first output signal of each of the plurality of flip-flop circuits in the preliminary shift register in response to an output signal from the output comparison circuit, wherein each of the first plurality of multiplexer circuits passes an output signal from one to a next one of the blocks, wherein each of the first and second pluralities of multiplexer circuits includes at least a CMOS transistor having at least an n-channel thin film transistor and a p-channel thin film transistor being connected complementarily.

5. A method according to claim 1, wherein said driving circuit further comprises at least two resistors each being selected from the group consisting of a pull-up resistor and a pull-down resistor, wherein one of said two resistors is connected to the final stage of flip-flop circuit in the main shift register circuit while the other of said two registers is connected to the monitoring flip-flop circuit.

6. A method according to claim 2, wherein said driving circuit further comprises at least two resistors each being selected from the group consisting of a pull-up resistor and a pull-down resistor, wherein one of said two resistors is connected to the final stage of flip-flop circuit in the main shift register circuit while the other of said two resistor is connected to the monitoring flip-flop circuit.

7. A driving circuit according to claim 3 further comprises at least two resistors each being selected from the group consisting of a pull-up resistor and a pull-down resistor, wherein one of said two resistor is connected to the final stage of flip-flop circuit in the main shift register circuit while the other of said two resistors is connected to the monitoring flip-flop circuit.

8. A driving circuit according to claim 4 further comprises at least two resistors in each of the blocks, each of the two resistors being selected from the group consisting of a pull-up resistor and a pull-down resistor, wherein one of said two resistors is connected to the final stage of flip-flop circuit in the main shift register circuit while the other of said two resistors is connected to the monitoring flip-flop circuit.

* * * * *